US005970420A

United States Patent [19]

Scott

[11] Patent Number: 5,970,420

[45] Date of Patent: Oct. 19, 1999

[54] METHOD FOR DECONTAMINATING HAZARDOUS MATERIAL CONTAINERS

[75] Inventor: John A. Scott, Arcadia, Calif.

[73] Assignee: Parsons Infrastructure & Technology Group, Inc., Pasadena, Calif.

[21] Appl. No.: 08/927,073

[22] Filed: Sep. 11, 1997

[51] Int. Cl.[6] ..... A62D 3/00

[52] U.S. Cl. ..... 588/200; 588/203; 588/226

[58] Field of Search ..... 588/200, 203, 588/226

[56] References Cited

U.S. PATENT DOCUMENTS

| | | | |
|---|---|---|---|
| 3,440,096 | 4/1969 | Scott | 588/200 |
| 3,810,788 | 5/1974 | Steyermark | 588/200 |
| 4,758,387 | 7/1988 | Sayles | 264/3.1 |
| 4,875,587 | 10/1989 | Galloway | 422/189 |
| 5,370,845 | 12/1994 | Miller et al. | 422/186.3 |
| 5,470,544 | 11/1995 | Galloway | 422/213 |
| 5,516,971 | 5/1996 | Hurley | 588/203 |
| 5,611,947 | 3/1997 | Vavruska | 219/121.52 |
| 5,737,079 | 4/1998 | Getty et al. | 588/202 |

OTHER PUBLICATIONS

U.S. Congress, Office of Technology Assessment, Disposal of Chemical Weapons: Alternative Technologies–Background Paper, OTA–BP–O–95 (Washington, DC: U.S. Government Printing Office), Jun. 1992.

*Primary Examiner*—Gary P. Straub
*Assistant Examiner*—Melanie C. Wong
*Attorney, Agent, or Firm*—Sheldon & Mak; Denton L. Anderson

[57] ABSTRACT

A process is provided for decontaminating metal objects, such as warhead components having hazardous materials adherent thereto. In the process, the objects are contacted with steam at a temperature above about 1,000 degrees Fahrenheit for a period of at least about 15 minutes under sub-atmospheric conditions. Thereafter, the steam used in the process is condensed to form a condensate and the condensate is used as a makeup component for an aqueous pacifying solution for pacification hazardous materials.

12 Claims, 1 Drawing Sheet

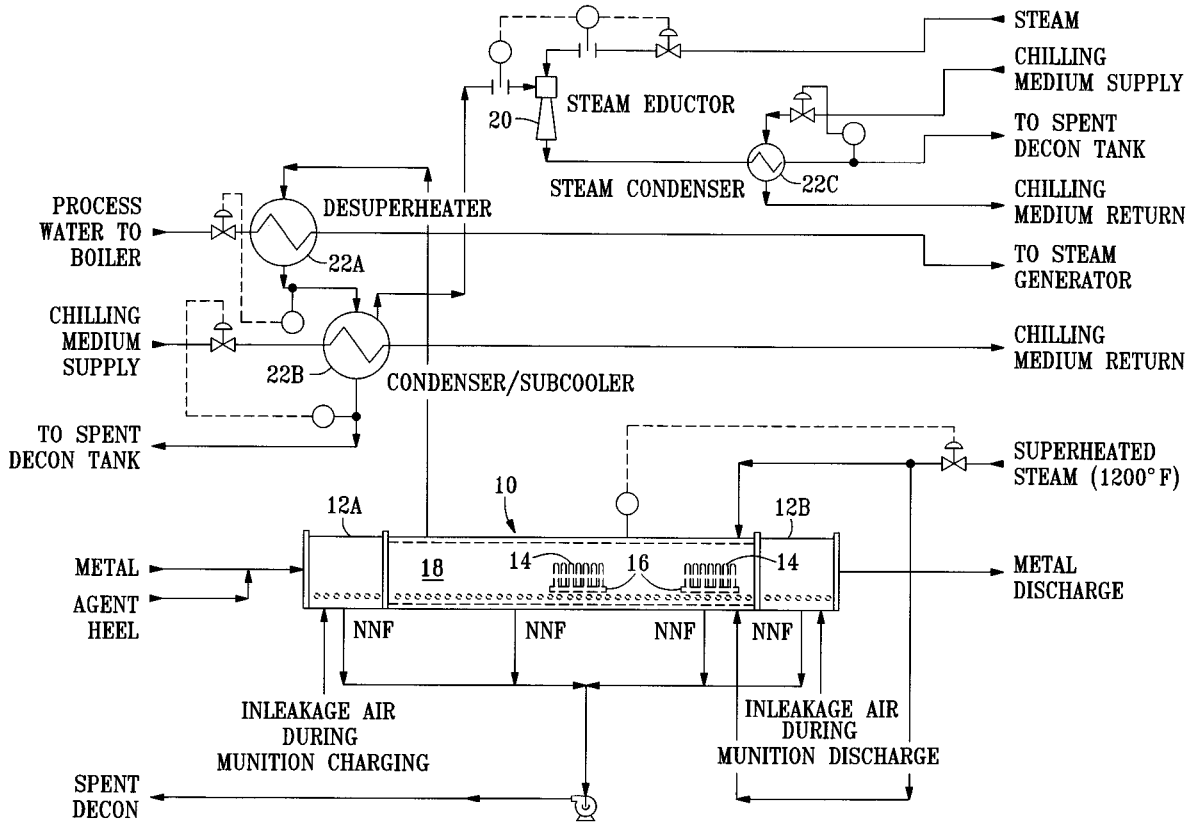

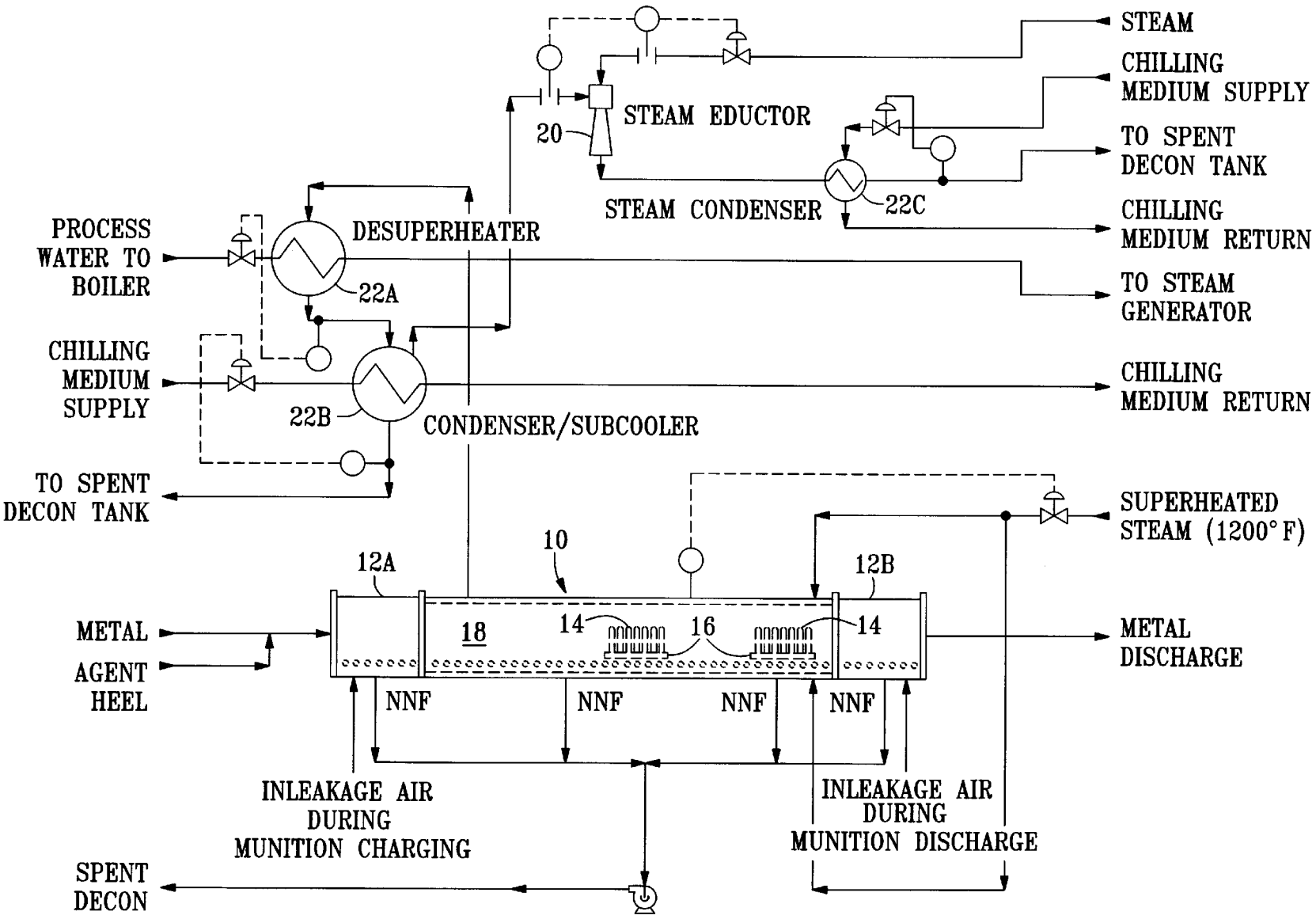
STEAM
CHILLING MEDIUM SUPPLY
TO SPENT DECON TANK
CHILLING MEDIUM RETURN
TO STEAM GENERATOR
CHILLING MEDIUM RETURN
SUPERHEATED STEAM (1200° F)
METAL DISCHARGE
22C
STEAM EDUCTOR
STEAM CONDENSER
20
DESUPERHEATER
22A
CONDENSER/SUBCOOLER
22B
12B
14
16
10
18
12A
NNF
INLEAKAGE AIR DURING MUNITION DISCHARGE
INLEAKAGE AIR DURING MUNITION CHARGING
PROCESS WATER TO BOILER
CHILLING MEDIUM SUPPLY
TO SPENT DECON TANK
METAL
AGENT HEEL
SPENT DECON

METHOD FOR DECONTAMINATING HAZARDOUS MATERIAL CONTAINERS

FIELD OF THE INVENTION

This invention relates generally to the pacification of hazardous materials, and specifically to the pacification of hazardous materials adherent to metal objects, such as to spent hazardous material containers.

BACKGROUND OF THE INVENTION

The pacification of hazardous materials is a major problem facing the world today. The problem is particularly acute where the hazardous materials are contained within sealed containers, such as military cannon shells or warheads containing explosives, chemical warfare materials or other deadly materials.

Historically, many such hazardous materials have been pacified by incineration. However, there is increasing concern that the combustion products from such incineration pose a potential health risk. Accordingly, in some recently developed processes, hazardous materials were pacified by being contacted with one or more pacifying solutions.

In such solution pacification methods, a problem arises as to how to thoroughly decontaminate the metallic components which formerly made up the hazardous materials containers—without incineration methods.

Accordingly, there is a need for a non-incineration method for decontaminating hazardous material containers.

SUMMARY

The invention satisfies this need. The invention is a process for decontaminating objects having hazardous materials adhered thereto. The process of the invention is carried out in combination with a solution pacification products wherein hazardous materials are contacted within a reactor vessel with an aqueous pacifying solution. In the invention, the objects are contacted with steam at a temperature above about 400 degrees Fahrenheit for a period of at least about 5 minutes. Steam from this process is condensed to form condensate and the condensate is used as a makeup material for the aqueous pacifying solution.

In a typical embodiment, the aqueous pacifying solution is a strongly basic solution and the objects are contacted with steam at a temperature above about 1,000 degrees Fahrenheit for at least about 15 minutes. Thereafter, the condensate from the steam is used as a makeup solution in the preparation of the strongly basic pacifying solution.

DRAWINGS

These features, aspects and advantages of the present invention will become better understood with regard to the following description, appended claims and accompanying figures where:

FIG. 1 is a flow diagram showing a process having features of the invention.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a process for decontaminating objects having hazardous materials adhered thereto. The method is used in combination with a solution pacification process wherein the hazardous materials are pacified by being contacted with an aqueous pacifying solution in a reactor vessel.

In the invention, the objects (such as metallic components of hazardous materials containers) are contacted with steam at a temperature above about 400 degree Fahrenheit for a period of at least about 5 minutes. Thereafter, the steam is condensed to form condensate and the condensate is delivered to the reactor vessel for use as a component in the pacifying solution.

The steam is generally super heated steam, such as super heated 150 psi steam. Preferably, the temperature of the steam is at least about 1,000 degrees Fahrenheit.

The objects are contacted with the steam for as long as necessary to complete the decontamination of the object. Preferably the objects are contacted with the steam for at least about 15 minutes.

As illustrated in FIG. 1, the process is conveniently carried out within an enclosed horizontal vessel 10 having airlocks 12 at opposite ends of the vessel 10. The objects 14, which can be portions of bombs, warheads or other hazardous material containers, are placed in metal trays 16 and loaded through the charge airlock 12*a* into the enclosed vessel 10. Use of the charge airlock 12*a* on the inlet and the discharge airlock 12*b* on the discharge end effectively prevent air and other non-condensible gases from entering the heating chamber 18 within the enclosed vessel 10.

After the objects 14 have been loaded within the heating chamber 18, steam, such a super-heated steam at temperatures at least above about 400 degrees, and preferably at least above 1,000 degrees Fahrenheit, is introduced into the heating chamber 18. The objects 14 are contacted with the steam for at least 5 minutes, preferably for at least about 15 minutes, to thoroughly decontaminate the objects 14. After decontamination, the objects 14 are removed from the heating chamber 18 through the discharge airlock 12*b*, where upon the objects 14 can be recycled or disposed of in a non-hazardous dumpsite.

Preferably, the process is carried out at a pressure less than atmospheric to minimize any chance of hazardous materials being leaked to the atmosphere from the heating chamber 18. In the embodiment illustrated in FIG. 1, this is accomplished by use of a steam eductor 20.

The condensate from the steam used to contact the objects within the heating chamber is captured and condensed in heat exchangers 22*a*, 22*b* and 22*c* to form condensate. Since the condensate may contain trace quantities of the hazardous materials or decomposition products thereof, the condensate, itself, may be considered hazardous. The problem of how to dispose of this condensate is solved by using the condensate as a makeup component for the aqueous pacifying solution used in the solution pacifying process for pacifying hazardous materials. In a typical such solution pacification process, hazardous materials are contacted with an aqueous pacifying solution, such as a basic solution having a pH greater than about 7, preferably greater than about 11. Thereafter, if additional pacification is required, the hazardous materials are transferred to one or more additional treatment reactors, such as bioreactors where the hazardous materials can be fully decomposed to benign decomposition products.

The invention has been found to provide an effective and inexpensive way of decontaminating hazardous material containers and other objects having hazardous materials adherent thereto—without the risks of incineration. Because all of the process is carried out sub-atmospherically and because the heating medium is wholly condensible, no danger of air pollution is created. A potential problem of condensate disposal is conveniently solved by using the condensate as a makeup solution for parallel hazardous materials pacification processes using aqueous pacifying solutions.

What is claimed is:

1. In a combination process for pacifying hazardous materials and for decontaminating objects having hazardous materials adhered thereto, wherein the combination process comprises the step of contacting the hazardous materials within a first reactor vessel with an aqueous pacifying solution, the improvement comprising the steps of:

(a) supplying steam at a temperature above about 1,000 degree Fahrenheit;

(b) contacting the objects with said steam;

(c) thereafter condensing the steam to form condensate; and (d) delivering the condensate to the reactor vessel for use as a component in the pacifying solution.

2. The combination process of claim No. 1 wherein the objects are contacted with steam for at least about 15 minutes.

3. The combination process of claim No. 1 wherein the objects are contacted with steam within an enclosed vessel.

4. The combination process of claim No. 3 further comprising the initial steps of loading the objects within the enclosed vessel through an airlock and immediately thereafter purging the airlock with an inert gas to purge all non-steam gasses from the enclosed vessel.

5. The combination process of claim No. 3 wherein the objects are contacted with steam within the enclosed vessel while the vessel is at a pressure less than atmospheric pressure.

6. The combination process of claim No. 1 wherein the aqueous pacifying solution has a pH greater than about 7.

7. The combination process of claim No. 1 wherein the aqueous pacifying solution has a pH greater than 11.

8. The process of claim No. 1 wherein the objects are portions of a military shell or warhead.

9. The process of claim No. 1 wherein the hazardous materials comprise explosives or chemical warfare agents.

10. In a combination process for pacifying hazardous materials and for decontaminating objects having hazardous materials adhered thereto, wherein the combination process comprises the step of contacting the hazardous materials within a first reactor vessel with an aqueous pacifying solution, the improvement comprising the steps of:

(a) supplying superheated steam at a temperature above about 1,000 degree Fahrenheit (b) contacting the objects with said super-heated steam for at least about 15 minutes, at a pressure less than atmospheric;

(b) thereafter condensing the steam to form condensate; and (c) using the condensate to the reactor vessel for use as a component in the pacification solution has been substituted therefor.

11. The process of claim No. 10 where the objects are portions of a military shell or warhead.

12. The process of claim No. 10 wherein the hazardous materials comprise explosives or chemical warfare agents.

* * * * *